US006988286B2

(12) United States Patent
Schecter et al.

(10) Patent No.: US 6,988,286 B2
(45) Date of Patent: Jan. 24, 2006

(54) CUSHIONING DEVICE AND METHOD OF PRODUCING THE SAME

(75) Inventors: Daniel B. Schecter, Richmond, VA (US); Jeffrey D. Martin, Richmond, VA (US)

(73) Assignee: Carpenter Co., Richmond, VA (US)

( * ) Notice: Subject to any disclaimer, the term of this patent is extended or adjusted under 35 U.S.C. 154(b) by 114 days.

(21) Appl. No.: 10/209,193

(22) Filed: Aug. 1, 2002

(65) Prior Publication Data

US 2004/0019972 A1 Feb. 5, 2004

(51) Int. Cl.
*A47C 20/00* (2006.01)

(52) U.S. Cl. ..... 5/645

(58) Field of Classification Search ..... 5/645, 5/636, 655, 691

See application file for complete search history.

(56) References Cited

U.S. PATENT DOCUMENTS

| | | | | | |
|---|---|---|---|---|---|
| 2,759,200 | A | | 8/1956 | Johnston | |
| 2,805,428 | A | * | 9/1957 | Buchman | 5/645 |
| 3,109,182 | A | * | 11/1963 | Doak | 5/636 |
| 3,148,389 | A | * | 9/1964 | Lustig | 5/645 |
| 3,175,230 | A | * | 3/1965 | Herdal | 5/491 |
| 3,283,346 | A | * | 11/1966 | Marsh et al. | 428/101 |
| 3,443,267 | A | * | 5/1969 | Schuckman | 5/645 |
| 3,594,833 | A | * | 7/1971 | Richter | 5/1 |
| 3,648,308 | A | | 3/1972 | Greenwalt | |
| 3,695,691 | A | * | 10/1972 | Putnam | 297/223 |
| 4,184,237 | A | * | 1/1980 | Blankenship | 29/91.1 |
| 4,207,636 | A | * | 6/1980 | Ceriani | 428/101 |
| 4,508,044 | A | * | 4/1985 | Downey et al. | 112/475.08 |
| 4,753,480 | A | | 6/1988 | Morell | |
| 4,753,705 | A | * | 6/1988 | Poncy | 156/292 |
| 4,754,513 | A | | 7/1988 | Rinz | |
| 4,756,949 | A | * | 7/1988 | Spence et al. | 428/159 |
| 4,776,048 | A | * | 10/1988 | Wilheim | 5/636 |
| 4,777,855 | A | | 10/1988 | Cohen | |
| 4,930,173 | A | * | 6/1990 | Woller | 297/452.48 |

(Continued)

FOREIGN PATENT DOCUMENTS

EP 258847 A1 * 3/1988

(Continued)

OTHER PUBLICATIONS

SmartBargains® 300TC Double Support While Down Gusseted Pillow, (which was available for sale on SmartBargains® website at least as early as Nov. 9, 2000 according to "waybackmachine" on www.archive.org).*

(Continued)

*Primary Examiner*—Michael Safavi
*Assistant Examiner*—Gay Ann Spahn
(74) *Attorney, Agent, or Firm*—Smith Gambrell & Russell LLP

(57) ABSTRACT

A cushioning apparatus such as a pillow which includes an upper pocket with reception cavity for receiving preferably loose or grouped non-integral filler material such as down, fiberfill or fiber-balls and another pocket for receiving additional filler material such as a foam core filler material. The foam core filler material is preferably an integrated or monolithic foam body of, for example, visco-elastic or alternate polyurethane foam. The core preferably has a non-planar upper surface contour allowing for a relatively thin, consistent height upper pocket thickness. The pillow also preferably includes a lower pocket joined about its periphery to the upper pocket such as by way of an intermediate gusset panel with beading and with the lower pocket also receiving loose or non-integrated filler material and with the bottom surface of the core preferably having a convex surface such as one symmetrical with the top surface.

50 Claims, 6 Drawing Sheets

U.S. PATENT DOCUMENTS

| | | | | | |
|---|---|---|---|---|---|
| 4,949,411 | A | | 8/1990 | Tesch | |
| 4,961,982 | A | | 10/1990 | Taylor | |
| 4,975,996 | A | * | 12/1990 | Evans et al. | 5/731 |
| 5,294,392 | A | * | 3/1994 | Marcus | 264/118 |
| 5,459,894 | A | * | 10/1995 | Buonocore | 5/737 |
| 5,474,362 | A | * | 12/1995 | Albecker, III | 297/452.32 |
| 5,488,746 | A | * | 2/1996 | Hudson | 5/500 |
| 5,500,295 | A | | 3/1996 | Halm et al. | |
| 5,557,816 | A | * | 9/1996 | Pedersen et al. | 5/645 |
| 5,659,911 | A | | 8/1997 | Kirkbride et al. | |
| 5,689,844 | A | * | 11/1997 | Liu | 5/636 |
| 5,769,489 | A | | 6/1998 | Dellanno | |
| 5,778,470 | A | * | 7/1998 | Haider | 5/645 |
| 6,006,380 | A | | 12/1999 | Sramek | |
| 6,159,574 | A | | 12/2000 | Landvik et al. | |
| 6,182,312 | B1 | * | 2/2001 | Walpin | 5/636 |
| 6,189,168 | B1 | * | 2/2001 | Graebe | 5/644 |
| 6,327,725 | B1 | * | 12/2001 | Veilleux et al. | 5/644 |
| 6,347,421 | B1 | | 2/2002 | D'Emilio | |
| 6,578,218 | B2 | * | 6/2003 | Wassilefsky | 5/648 |
| 6,602,579 | B2 | * | 8/2003 | Landvik | 428/158 |
| 6,760,935 | B1 | * | 7/2004 | Burton et al. | 5/645 |
| 2001/0018777 | A1 | | 9/2001 | Walpin | |
| 2001/0021438 | A1 | | 9/2001 | Landvik | |
| 2003/0177583 | A1 | * | 9/2003 | Freeman | 5/721 |
| 2004/0194270 | A1 | * | 10/2004 | Flippin | 29/91.1 |

FOREIGN PATENT DOCUMENTS

| | | |
|---|---|---|
| EP | 0 270 014 | 6/1988 |
| FR | 2 305 956 | 12/1976 |

OTHER PUBLICATIONS

SmartBargains® 233TC Jumbo Firm Support Tri Chamber Pillow, (which was available for sale on SmartBargains® website at least as early as Nov. 9, 2000 according to "waybackmachine" on www.archive.org).*

Carpenter Co. "Comfort Creations®—Personal Choice™ Bed Pillow" copy of bag packaging; © 1998; 2 pgs.

Carpenter Co. "Foamcor ® Pillow" copy of bag packaging; © 1991; 2 pgs.

Carpenter Co. "Quallofoam™ Bed Pillow" copy of bag packaging; © 1991; 2 pgs.

Carpenter Co. "Hollofoam™ Bed Pillow" copy of bag packaging; ©1994; 2 pgs.

Carpenter Co. "New Life™ Comfort Core Pillow™" copy of bag packaging; © 1999; 2 pgs.

"Memory Foam Beds and Mattresses" and "Pillow and Back Care Products" from the abed.com website, http://www.abed.com, pulled from internet Nov. 1, 2002, date first publication available not known, 6 pgs.

Sleep Innovations "Novaform Naturals"—1-pg. printout from Linens 'n Things website; http://www56.Int.com; pulled from Internet Dec. 6, 2002; product on market earlier.

Sleep Innovations, "Novaform Naturals" pillow product, (7 pages—breakout of insert facing portion).

Carpenter Co. "Isotonic Sleep System Brochure", date first publication available not known.

Carpenter Co. "Dual Comfort Bed Pillow" advertisement/insert, date first publication available not known, 2 pgs.

Carpenter Co. "Comfort Creations—Personal Choice" advertisement/insert, date first publication available not known, © 1998.

Carpenter Co. "New Life Comfort Core Pillow" advertisement/insert, date first publication available not known.

Carpenter Co. "New Life Comfort Core—Mattress Pad" advertisement/insert, date first publication available not known, © 2002.

Carpenter Co. "Isotonic—Mattress Pad" advertisement/insert, date first publication available not known, © 2001.

"Egyptian Cotton, Antibacterial Products, Indulgence" from the Carpenter Co. website, http://www.carpenter.com, pulled from the internet Jun. 21, 2002, date first publication available not known, 3 pgs.

"Density in Flexible Polyurethane Foam (FPF)" from the PFA website, http://www.pfa.org/ee/lesson1.html, pulled from internet internet on Jul. 26, 2002, date first publication available not known, 4 pgs.

"Properties that Affect FPF Performance" from the PFA website, http://www.pfa.org/ee/lesson1.html, Pulled from internet internet Jul. 26, 2002, date first publication available not known, 4 pgs.

"Typical Density Ranges for Different Foam Applications" from the Healthy Foundations website, http://www.healthyfoundations.com, pulled from internet Jul. 26, 2002, date first publication available not known, 1 pg.

"How I Became A Visco-Elastic Foam Junkie" from the Healthy Foundations website, http://www.healthyfoundations.com, pulled from internet Jun. 21, 2002, date first publication available not known, 2 pgs.Nov. 1, 2002.

"Isotonic Standard Pillow" from the Healthy Foundations website, http://www.healthyfoundations.com, pulled from internet Jun. 21, 2002, date first publication available not known, 2 pgs.

" Isotonic Topper Pad" from the Healthy Foundations website, http://www.healthyfoundations.com, pulled from internet Jun. 21, 2002, date first publication available not known, 2 pgs.

"Pressure Relief Memory Foam Products" from the Healthy Foundations website, http://www.healthyfoundations.com, pulled from internet Jun. 21, 2002, date first publication available not known, 4 pgs.

"Frequently Asked Questions" from the Healthy Foundations website, http://www.healthyfoundations.com, pulled from internet Jun. 21, 2002, date first publication available not known, 3 pgs.

"FAQ's—The Isotonic Mattress Set" from the Healthy Foundations website, http://www.healthyfoundations.com, pulled from internet Jun. 21, 2002, date first publication available not known, 6 pgs.

"Viscoelastic Cell, NASA Connection, Conforming, Anti-Mite & Anti-Allergy Testimonials" from the TEMPUR-PEDIC website, http://www.tempurpedic.com, pulled from internet Nov. 1, 2002, date first publication available not known, 7 pgs.

* cited by examiner 20
22
32
40
40
54
28
34
24
42
36
50
72
46
44
48
IA
IA
IB
IB
34
36
38
30
26
52
72

76
74
62
80
44
70
46
64
36
48
68
66

76
58
78
24
74
60
57
34
48
46
44
38
56
59

CUSHIONING DEVICE AND METHOD OF PRODUCING THE SAME

FIELD OF THE INVENTION

The present invention is directed at a cushioning device with preferred embodiments directed at a pillow cushioning device, preferably a pillow cushioning device having an intermediate foam core and one or more outer filler material filled pockets.

BACKGROUND OF THE INVENTION

Pillows come in a variety of forms, with the more typical consisting of rectangular, fabric enclosures filled with feathers, down, chipped foam, or a polyester fill. These pillows may be shaped by the user to provide reasonably adequate support for the user while the user falls asleep. However, many people suffer from an uncomfortable night's sleep because of the inadequate support that their head and neck receive while using these traditional pillows throughout the night. This is because traditional pillows either have a body that is so soft that the neck support area compresses to result in no support, or the body is so firm that the head sits considerably higher than the shoulders of the user, resulting in an abnormal sleeping position. Chronic neck pain or stiffness and a tense upper back are often the result of these inadequate forms of support these traditional pillows provide.

Various foam pillows have also been developed typically comprising a foam body taking the place of the above-noted fillers and inserted into an overall fabric enclosure. These foam based pillows avoid problems such as filler clumping and can facilitate washing by allowing for easier removal of the pillow support from its fabric enclosure.

There is also known in the art a pillow featuring a foam core generally surrounded by loose fiber. There can be, however, an undesirable degree of migration or area clumping with a pillow having a foam core generally surrounded by fiberfill within a ticking.

SUMMARY OF THE INVENTION

The present invention is directed at providing a cushioning device such as a pillow or mattress topper which utilizes a core and outer layer arrangement generally directed at providing desirable load support features in conjunction with good "look and feel" contact characteristics.

An embodiment of the present invention includes a cushion apparatus having a first flexible pocket defining a filler reception cavity with a first pocket filler material received within the reception cavity of the first flexible pocket. Preferably, the first pocket filler material is formed of a compilation of individual filler material components. A preferred embodiment also features a second flexible pocket defining a second filler reception cavity within which is received second pocket filler material. A flexible core is positioned between the first and second flexible pockets such as an arrangement where the upper pocket fully covers the top of the flexible (e.g. foam) core and the lower pocket fully covers the lower surface of the core with each preferably having peripheral overhang. The second pocket filler material is also preferably formed of a compilation of individual filler material components such as down material, polyester fiberfill material, and/or polyester fiber-ball material.

When down is used as a filler material, an amount of 2 to 5 ozs. (e.g. 4.5 or 5 ozs.) is preferred, and the average thickness of the first pocket is preferably 0.5 to 2 inches. When the first pocket filler material is a polyester fiberfill material, there is preferably utilized an amount of 2 to 12 ozs. per pocket with 5 to 8 ozs. being preferable to facilitate providing the desired thickness in the pocket relative to the supporting core materials. A preferred cushion is in the form of a pillow with the first and second pockets having the same characteristics (e.g. the average thickness of each pocket being 0.75 to 1.5 inches with 0.85 to 1.25 inches being a preferred sub-range).

The core is preferably formed of a foam material (e.g. a polyurethane foam material including visco-elastic foam materials). Also, a preferred pillow embodiment features a core with a convex exposed surface supporting the first pocket, and also preferably a similar relationship (symmetric arrangement both core and ticking) for the second pocket and core bottom surface. A foam core of visco-elastic foam when utilized, preferably has a density of 30 to 60 kg/m$^3$ and a hardness range of 25N to 90N measured at 25% compression at 20 degrees Celsius, and takes up a majority of the overall height of the cushion even relative to the sum of the upper and lower pockets.

The first and second flexible pockets are preferably connected together such as by way of an intermediate cover section which is connected to a peripheral region of said first and second flexible pockets. The intermediate cover section preferably, further includes an intermediate gusset section extending peripherally about the core. The noted intermediate gusset section includes a first peripherally extending upper gusset section, a second peripherally extending gusset section and an inner border line between said upper and lower peripherally extending gusset sections.

There is also preferably included at least one bead defining a border edge of at least one of said upper and lower gusset sections. The bead(s) preferably include(s) a bead cord and a cloth covering for one or two possible upper and lower gusset beads.

The present invention also features a method of forming a cushion such as a pillow that includes providing a cover having a first pocket, a second pocket, and an intermediate pocket, inserting filler material in the first and second pockets, and inserting a core filler in the intermediate pocket. The step of inserting filler material preferably includes inserting filler material of down, fiberfill, fiberballs, etc. or combination thereof in each of the outer pockets (e.g. by hand or an automated process). A visco-elastic foam or an alternate polyurethane foam core placed in the intermediate pocket represent suitable core fillers.

BRIEF DESCRIPTION OF THE PREFERRED EMBODIMENTS

DETAILED DESCRIPTION OF THE PREFERRED EMBODIMENTS

Figures 1, 1A, 1B:
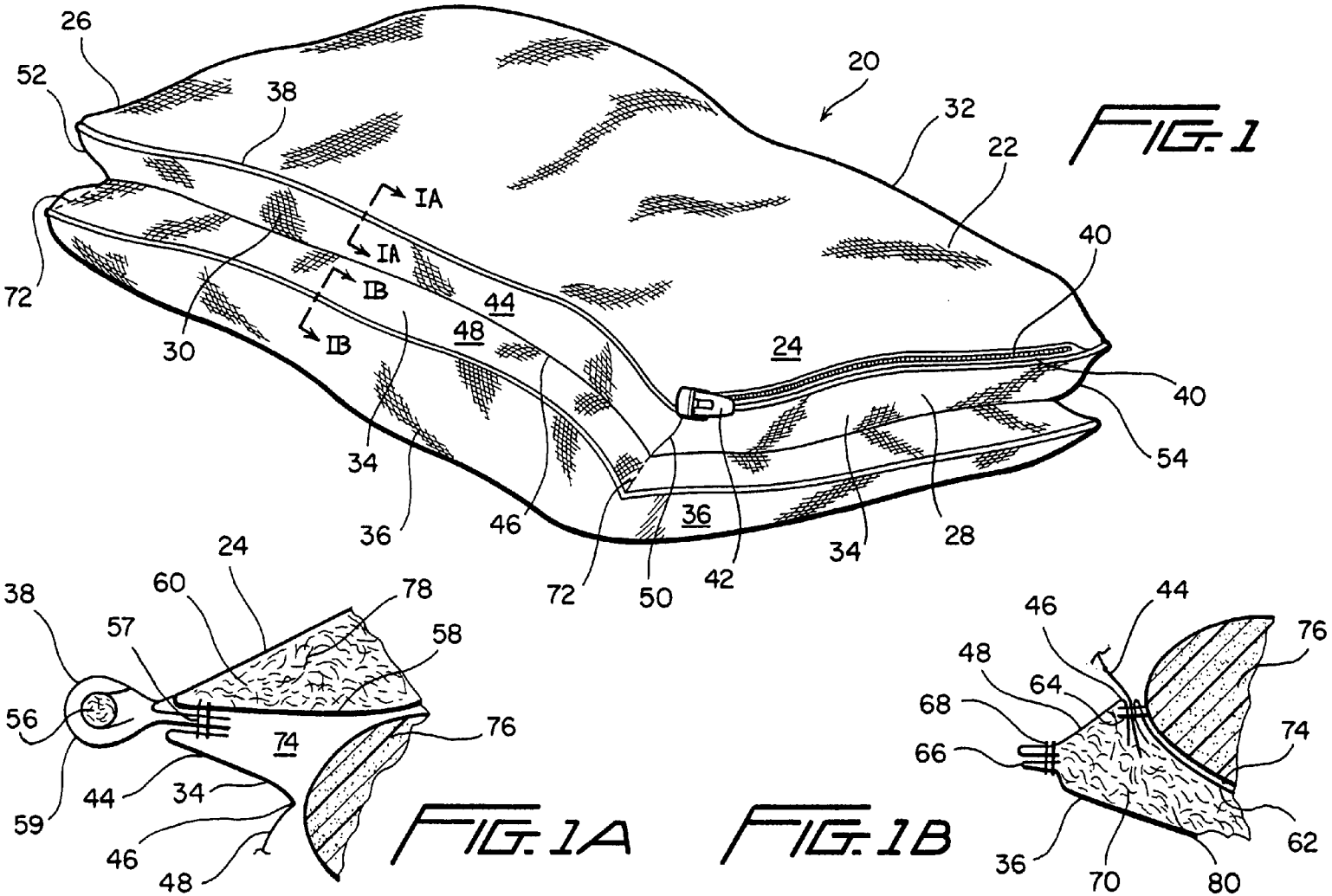
FIG. 1 shows a perspective view of a first embodiment of the pillow of the present invention.
FIG. 1A shows an enlarged cross-sectional view of a portion of FIG. 1 along cross-section line IA—IA (see also the circled region in FIG. 4).
FIG. 1B shows an enlarged cross-sectional view of another portion of FIG. 1 along cross-section line IB—IB (see also the circled region in FIG. 4).

FIG. 1 shows, in perspective, a first embodiment of the present invention in the form of pillow 20. As shown in FIG. 1, pillow 20 comprises cover 22 which is of a flexible material such as a textile material, non-woven material, plastic sheeting or laminate. That is, various cover materials are usable depending on the desired environment of use, including, for example, water impervious and non-water impervious materials (e.g. vinyl sheeting, neoprene fabric, natural fiber fabrics such as cotton, man-made fiber fabrics such as polyester and woven and unwoven materials as a few examples). In a preferred embodiment, the cover material is a breathable fabric such as cotton (e.g. 100% or mixtures with other materials such as polyester or rayon) having, for example, a thread count of 200 to 300). Cover 22 is loose enough to enable the cover to conform to depressions and contortions anticipated in use such as the compression forces induced by the head and limited by the interior pillow core contents described below. The cover is strong enough, however, to avoid ripping during usage and in most uses is machine washable.

Figure 2:
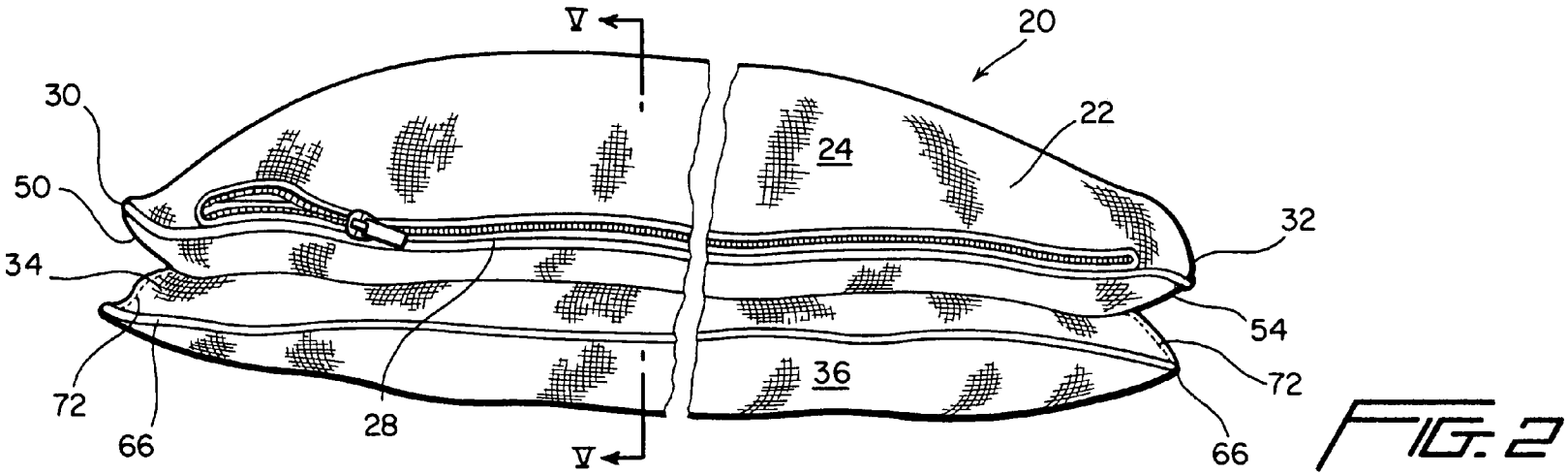
FIG. 2 shows an elevational end view of the pillow of FIG. 1 with intermediate cut away.
Figure 3:
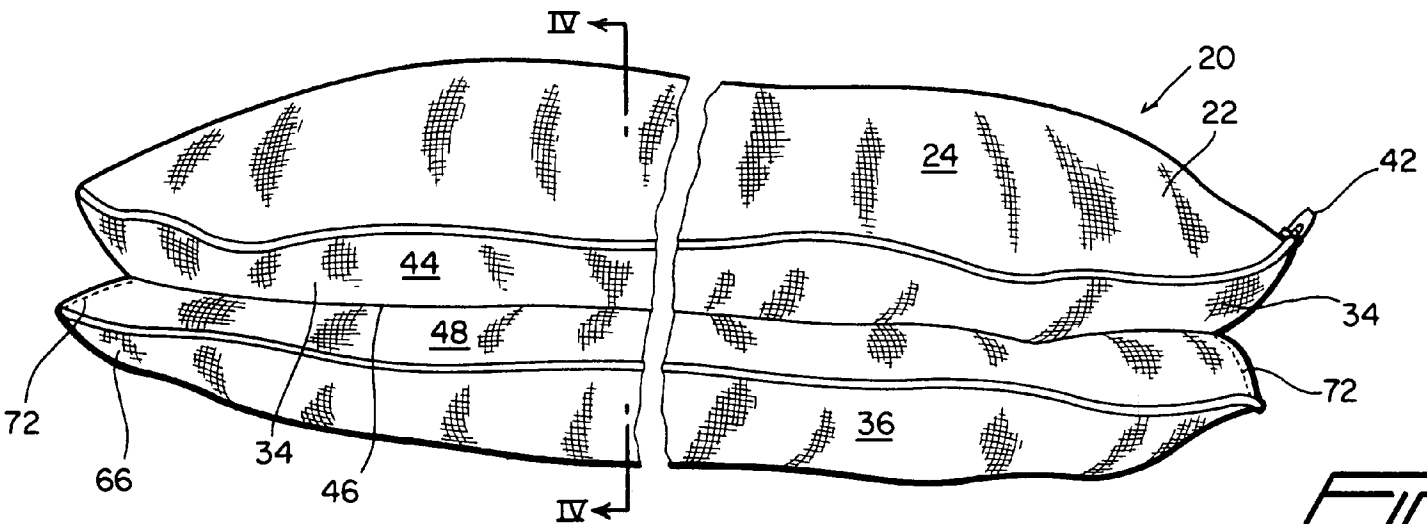
FIG. 3 shows an elevational side view of the pillow of FIG. 1 with an intermediate cut away.

As can be seen from a review of FIGS. 1, 2 and 3, cover 22 includes an upper top layer 24. It should be noted that "top" and "bottom" have been used merely to facilitate the discussion of the illustrated embodiments, as the pillow can be used with the illustrated "top" layer in the down or support contact position. Top layer 24 can be of a variety of peripheral shapes such as those most common in pillows (e.g., rectangular and circular), with a rectangular embodiment being illustrated. FIG. 1 thus illustrates pillow 20 having ends 26, 28 and more elongated sides 30, 32. In a preferred embodiment of the present invention, because of the shape of the below described interior pillow contents, upper top layer 24 assumes a convex cross-section end-to-end and a conforming cross-sectional convex surface in the side-to-side direction as well.

As further shown in FIG. 1, pillow 20 has an intermediate gusset zone 34 which preferably extends about the entire periphery of pillow 20, although alternate embodiments of the invention include variations relative to this feature, such as a no gusset panel, two edge or three edge only gusset embodiments, or where gussets are only provided along the elongated sides or a portion of the periphery or around all sides but for one side or section made openable for interior access.

FIGS. 1–3 also illustrate pillow 20 having lower bottom layer 36 which preferably is similar in material and general layout relative to that of upper top layer 24. Intermediate gusset zone 34 is also preferably of the same material utilized for the top and bottom layers, but other material combinations are included in the present invention including, for example, elastic material intermediate panels. Intermediate gusset zone 34 is also preferably centrally positioned relative to the upper top layer 24 and lower bottom layer 36, but can also be provided so as to be closer to the top or bottom layer also such as by way of an added cloth flange extension.

At the border between gusset 34 and upper top layer 24, there is preferably provided an external, border edge or bead edge 38 which extends, in a preferred embodiment, continuously along sides 30, 32 and ends 26, 28 at the junction between the gusset zone 34 and the top layer 24. In the region of end 28 there is also preferably provided an access opening which in a preferred embodiment is access controlled by access means such as zipper 40 extending along end 28 with zipper ends positioned just inward of each side 30, 32. In FIG. 1, one of the ends includes zipper handle 42.

The section of bead 38 extending along end 28 is preferably positioned immediately below the lower half teeth run of the zipper 40 supported by a cloth or plastic strip base which in turn is secured to cover 22 on one side and on an opposite side, to the bead and/or to an upper region of the gusset zone. The bead and lower zipper tooth run (the actual teeth) are thus preferably arranged in a side-to-side relationship (e.g., in abutting contact) when the zipper is in an unzippered state.

FIG. 1 also illustrates gusset zone 34 as comprising upper gusset section 44, interior dividing line 46 and lower gusset section 48. Upper gusset section 44, in the rectangular embodiment illustrated, forms four corners, three of which are shown in FIG. 1 and represented by reference numbers 50, 52 and 54. In a preferred embodiment, upper gusset section 44 is continuous and uninterrupted with the visible gusset corners being smooth transition corners in the generally rectangular configuration of the pillow (similar to the smooth cornered beading 38) with hidden, interior ruffled corner zones (not shown) to accommodate the curvature.

With reference to FIG. 1A, taken along cross-section line, IA—IA of FIG. 1, bead 38 is preferably comprised of a bead insert 56 such as a string cord and bead cover 59. Bead insert 56 preferably runs continuously about pillow 20 to define a circular cross sectional bead that is sufficiently large as to permanently define the gusset upper boundary while providing additional peripheral tension cover strength. The beading preferably extends about the entire pillow including the same section of pillow having the zipper (which is an area of increased user handling).

Figure 4:
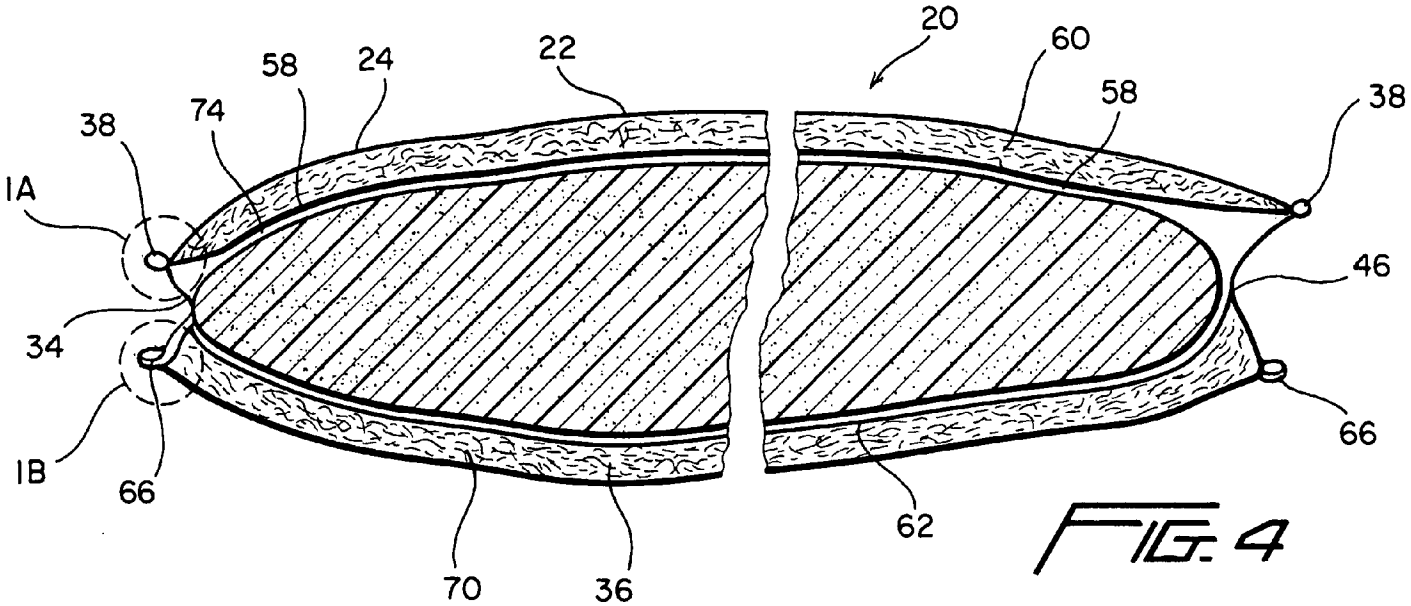
FIG. 4 shows a cross-sectional view of the pillow of FIG. 1 taken along cross-section line IV—IV in FIG. 3.

FIGS. 1A, 1B and FIG. 4 illustrate in cross-section additional features relative to the intermediate gusset zone 34. As seen from FIG. 1A upper top layer 24 is joined at its periphery inward of (and essentially at) bead 38 to upper bottom layer 58 (e.g. a fold-in arrangement for top cover 24 with the peripheral inwardly folded-edge of upper bottom layer 58 received in the recess defined by the inwardly extending top cover edge). As this connection (e.g. threaded double seam 57) extends peripherally about the pillow, there is formed upper filler pocket 60 in the upper half of pillow 20. Filler pocket 60 is preferably sealed peripherally about the entire pillow (including when zipper 40 is opened). Upper bottom layer 58 is also preferably formed of the same material as upper top layer 24 although variations are also included in the present invention including forming the outer cover layer 24 and upper bottom layer 58 of different materials (e.g., different grade fabrics or different type material such as netting and cloth combination).

FIG. 1B illustrates an expanded view of the bottom portion of intermediate gusset zone represented by expansion circle 1B in FIG. 4 taken in the region represented by cross-section line IB—IB of FIG. 1. As shown in FIG. 1B, upper gusset section 44 extends into connection with lower gusset section 48 and lower top layer 62 such as by way of a threaded connection 64 which extends about the periphery of pillow 20 (e.g. a threaded seam connecting abutting, interior fold edges for section 48 and layer 62 receiving therebetween an extension of upper gusset section 44). For example, lower gusset section 48 can be folded inward, lower top layer 62 can also be folded inward, and the inward folds of each defining a sandwich arrangement relative to an extension of upper gusset section therepast. The junction point of these preferably common material pillow sections defines intermediate gusset line 46 which is shown to represent the interiormost portion of the visible intermediate gusset zone 34. FIGS. 1, 1B and 4 also illustrate a second gusset bead or external border edge 66 that defines the lower border edge between intermediate gusset zone 34 and the lower bottom layer 36 of pillow 20. This second bead or border edge is provided to define and help maintain the shape of the lower gusset border edge. It can take on the same form as that of bead 38, but in a preferred embodiment is formed without a bead cord insert relying instead on stacked or folded bottom layers joined together by a threading, for example.

FIG. 1B illustrates one possible embodiment of gusset border edge 66 defined by a lower region of lower gusset section 48 and an upper region of lower bottom layer 36 so as to provide a symmetry of border effect relative to the top and bottom of gusset zone 34. In the FIG. 1B illustration, layer 36 and section 48 are separate sheets of material that are connected as by the illustrated threaded connection 68. The combination of layers or sections 36, 48 and 62 and the illustrated peripheral connections 64 and 68 define lower filler pocket 70 which, like above, has its peripheral edges sealed and the material is flexible enough to provide for some degree of vertical filler zone expansion and conformance to a preferred convex shaped bottom surface for the core. In a preferred embodiment, lower gusset zone 48 has its corners formed by threaded connections, two of four of which are denoted in FIG. 1 by dashed reference lines 72. The dual upper and lower individual pocket arrangement can be formed in a variety of other ways such as adhesive or heat bonding common peripheral edges of the upper pocket layers and the lower pocket layers. The pockets can also joined directly together at common peripheral edges, although the intermediate panel arrangement is preferred for maintaining less directly interlinked pocketed comfort zones.

Figure 5:
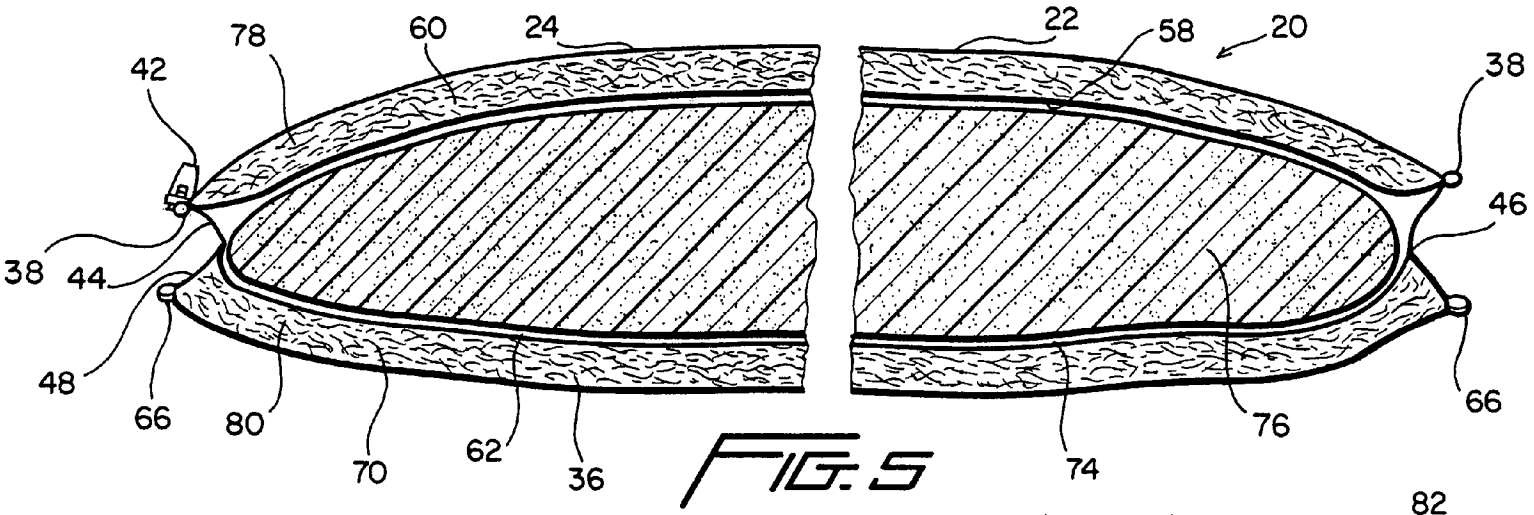
FIG. 5 shows a cross-sectional view of the pillow of FIG. 1 taken along cross-section line V—V in FIG. 2.

As shown in FIGS. 1A and 1B, between upper bottom layer 58 and lower top layer 62 is defined intermediate core pocket 74 which is limited peripherally by mainly the interior gusset line 46. As shown best by FIGS. 4 and 5, intermediate core pocket 74 provides a reception area for receipt of core 76. FIGS. 4 and 5 also illustrate, respectively, the above noted, filler pockets 60 and 70 containing filler material 78 and 80, respectively. The providing of the multiple pockets (e.g. upper, intermediate and lower) provides a wide variety of filler options (e.g. core or loose or non-integrated filler material) to a manufacturer (or user when the multipockets are made accessible—although in a preferred embodiment only the intermediate pocket 74 is made accessible by way of zipper 40). This versatility facilitates providing different products to suit different intended customer needs and desires, although a wide variance of universal comfort is achieved by the arrangements described herein. For example, with the preferably sealed upper and lower pockets, a wide variety of filler options are possible such as down and polyester fiber fillers. Suitable polyester or other man-made fiber fillers include, for example, such staple polyester fiber such as RICHLOFT® polyester fiber sold by Carpenter Co. or polyester fiber-balls such as disclosed in U.S. Pat. No. 5,344,707 which are described as avoiding a high degree of clumping (which is even further lessened by the relatively thin, individual pockets arrangement of the present invention).

In an illustrative preferred embodiment of the present invention, upper and lower filler pockets 60 and 70 contain a common filler material (as opposed to different filler materials which represents an alternate embodiment of the present invention). As best shown in FIGS. 1A, 1B, 4 and 5, one preferred embodiment of the invention features upper pocket 60 provided with a down feather filler 78 and the lower pocket 70 also provided with a down filler 80. A variety of down types and/or mixtures represent suitable down filler options such as gray duck down or white goose down, etc. with the preferred embodiment featuring a sealed pocket both from the standpoint of having peripheral sealed edging and a pocket forming material that, while preferably being breathable or air flow capable, blocks the escape of the filler material. In this context, cover 22 can be considered a ticking and a 100% cotton ticking with a suitable thread count (e.g. 200 to 300) to avoid down feather escape and/or partial exposure is preferred. Other well suited ticking fabric includes woven yarns of synthetic polyester continuous filament such as described in U.S. Pat. No. 5,659,911.

In a preferred embodiment of the invention, each pocket (60, 70) is preferably provided with down in an amount of 1 to 12 oz. of filler material with a preferred intermediate, general sub-range of 3 to 7 oz. being preferred. In one preferred embodiment, each pocket is provided with 2–5 oz. of down (e.g. 2–4 oz. of Gray Duck Down) with 4.5±0.5 oz. being well suited for many uses of the present invention. The above ranges of down for a preferred pillow shape provides the preferred pocket thickness height range of 0.5 to 2 inches, with a 0.75 to 1.25 inch thickness being well suited for most uses of the present invention and a 1 inch thickness being preferred. (The thickness of the filler and pockets are preferably made generally consistent (e.g. less than a 0.25 inch deviation) across the plane or curvature of the pocket although there can be expected to be some degree of reduction in the peripheral area where the two pocket forming panels are shown coming together for attachment). The thickness range is thus maintained relatively low relative to the height of the core (e.g. a relationship where half of the core height (maximum if non-planar)) is greater than the pocket thickness and preferably half the (maximum) core height is greater than the sum thickness of both pockets.

Rather than down (e.g., as some people are allergic to down and down is generally not recommended for washing, requiring dry cleaning), other filler materials are suited for use of the present invention including synthetic "staple fiber" including polyester fiberfill (e.g. polyethylene terephthalate staple (i.e. cut)) fibers with a preferred dtex of 5–6 and preferably slickened (e.g. coated with silicones or polyethylene terephthalate/polyether segmented copolymers to reduce friction and clumping). In one embodiment of the invention, each pocket is provided with 2 to 12 oz. of staple polyester fiberfill (e.g. the aforementioned RICHLOFT®. polyester fiber) with 5–8 oz. being a preferred sub-range used in forming embodiments of the present invention and 6 oz. being well suited for many uses of the present invention. These preferred ranges of fiberfill also generally provides a pocket thickness within the above described preferred range of 0.5 to 2 inches, as is the case for the down pocket filler.

Intermediate core pocket 74 also provides for reception of a wide variety of different core embodiments. The preferred intermediate pocket embodiment features an accessible pocket such as a pocket accessible by way of zipper 40. Core 76 is preferably a unitary or integrated (e.g. monolithic, laminated or interconnected) body which can have planar top, bottom and side surfaces, but is more preferably non-planar with convex top and bottom smooth surfaces. Thus, unlike a non-unitary or non-integral filler material which can be formed of a large number of separable or independent components such as down feathers and staple fibers (the preferred material for the upper and lower zones), the intermediate core preferably receives a unitary or integrated body. Alternate embodiments of the invention also include, however, variations both as to type and characteristics of the filler material for the upper and lower pockets and the core received in the intermediate pocket. These include, for example, the use of a non-unitary, non-integrated filler in the intermediate zone as a core material like the above noted fiberfill filler (e.g. cluster of fiber-balls or conjugated or staple fibers) or mixtures of foam and filler. Again, however, in a preferred embodiment, a unitary or integrated core body is preferably used in the intermediate pocket or layer in conjunction with a non-unitary, separable material such as the aforementioned down and fiberfill fiber in the upper and lower pockets. Accessibility such as by way of a zipper can be altered for the three illustrated pocket zones so as to make for example, all pockets accessible, all non accessible or each possible variation relative to the three different pockets which depends, for example, on what material is received in the pockets (a sealed pocket is preferred for a non-unitary inserted material).

Examples of integrated core bodies include, for example, a fluid filled body such as an air cushion, or more viscous gel core cushion or a foam body. Preferably, core 76 is formed as a molded body of a compressible foam material such as a polyurethane foam, synthetic or natural foam rubbers, or combinations (e.g. laminated layers) of these materials, etc. Preferred foams include visco-elastic foam, "conventional" polyurethane foams and high-resiliency polyurethane foams.

Visco-elastic foam was originally developed in the early 1970's at NASA's Ames Research Center in an effort to relieve astronauts of the g-forces experienced during lift off and then later placed on the market for medical use, particularly in combating decubitus ulcers, by the Swedish company Fagerdala World Foams AB under the mark TEMPUR-PEDIC® foam. The medical pad products formed by Fagerdala World Foams AB are formed from visco-elastic foam described as being made by A/S Dan-Foam, 5560 Arup, Denmark under the trademark TEMPUR® foam.

Visco-elastic foam is also made by Carpenter Co. of Richmond, Va. under the trademark VISCOLUX® foam and CONFORM® foam.

Visco-elastic foam is a high density, visco-elastic, open-cell material. The open-cells are generally spherical with windows and are temperature and weight sensitive (becoming softer upon being heated such as by body heat). When a visco-elastic material is utilized as the core of the present invention, the preferred density range is 16 to 120 kg/m$^3$, more preferably 16–95 kg/m$^3$, with 30–60 kg/m$^3$ and 40–45 kg/m$^3$ being preferred sub-ranges. A hardness ranging from 25 to 90N at 25% compression at 20° C. represents a preferred hardness range with 30 to 40N being a preferred sub-range and 35N a preferred value therein. For pillows, a 25% compression value is most informative due to the typical compression force asserted by a user's head. It is also noted that a preferred hardness range of 10N to 60N is applicable at 65% compression at 20° C. The alternate "conventional" and "high resiliency" polyurethane foams also preferably have the above noted visco-elastic foam density and hardness ranges and values. Suitable "conventional" densified polyurethane foam includes OMALAN® and HYPERSOFT® foam products of Carpenter Co. and a suitable high-resiliency foam includes QUALATEX® foam of Carpenter Co.

Figure 8:
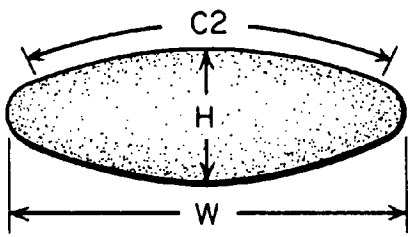
FIG. 8 shows a schematic end elevational view of the foam core.
Figure 7:
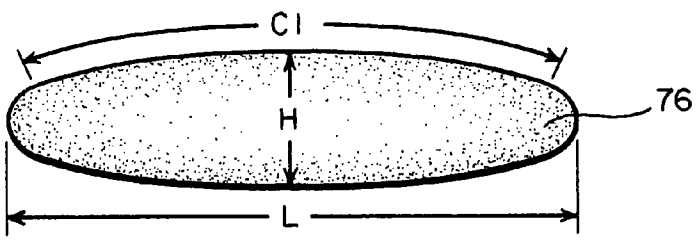
FIG. 7 shows a schematic side view of a foam core of the present invention.
Figure 9:
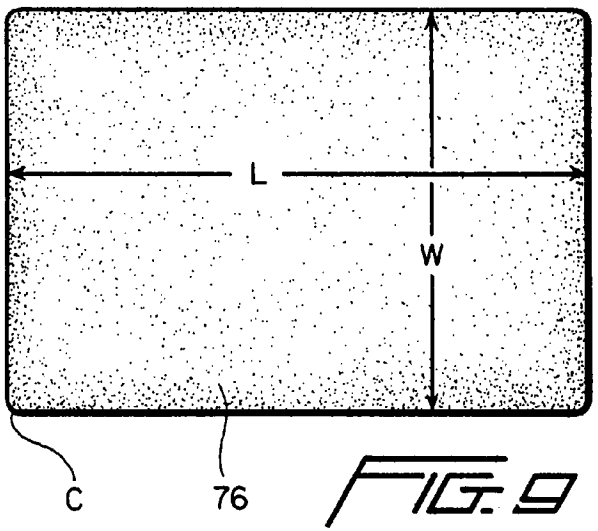
FIG. 9 shows a top plan view of the foam core.

FIGS. 6–10 of the present invention illustrate some preferred features for foam core 76 such as the above described visco-elastic and alternate polyurethane foam materials. FIGS. 7–9 provide a schematic illustration of some preferred sizing characteristics, which are well suited for use in combination with the above and below described upper and lower pocket filler material embodiments. FIG. 7 illustrates a preferred configuration for core 76 as a monolithic or integrated foam body having a smoothly curved domed or convex configuration both relative to the width W direction and across the length L direction, with the highest areas relative to both the upper and lower half sections (a preferred arrangement of the present invention features a common shape relative to a bisecting horizontal plane which is represented by the peripheral mold edging line M in FIG. 6) being in the center of the pillow. A molding formation technique is a preferred method of production for the visco-elastic foam material and is suitable for other types of polyurethane foam. Core 76 can also be formed by other common core forming techniques such as contour cutting or convoluted roller, conveyor or impression die plate contouring techniques.

Figures 6, 13:
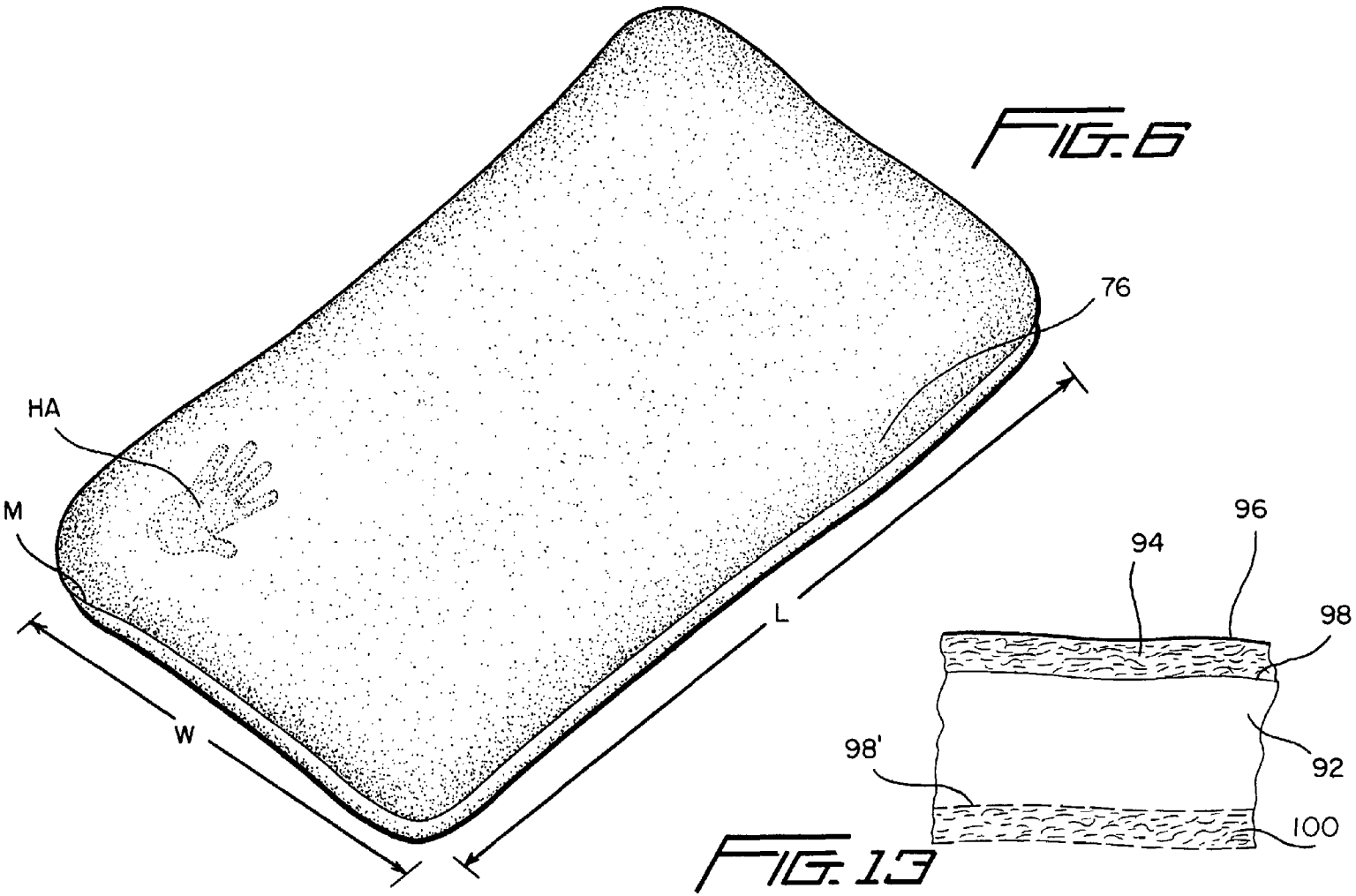
FIG. 6 shows a perspective view of a foam core of the present invention.
FIG. 13 shows in schematic cutaway fashion a cushioning device such as a mattress topper.

FIG. 6 illustrates the conforming nature of visco-elastic foam which assumes the contour of whatever object is compressed into the material and retains it while the compressive force is in effect and even for a brief time period following release of the compression as illustrated by hand print HA shown in the foam body in FIG. 6 after removal of a compressing hand (now shown). This ability to directly conform to the contouring of a compressive body provides a high level of low pressure support as all points or essentially all points of possible contact find foam support. The fact that the foam material softens with body heat also means that the higher compression areas will tend to heat up the most, and correspondingly soften the most applicable pressure points. Visco-elastic foam is also described as being breathable. Despite this breathability, the direct conforming support, typically with only a cloth barrier between the user and foam body in the prior art, provides little chance for any convective or conductive heat flow external to the foam body, relying instead on the breathability of the foam itself to remove and dissipate the heat.

The present invention features, in a preferred embodiment, a filler material that is interposed, together with the covering or ticking between the compressing object (e.g., a head in the instance of a pillow), and the receiving core 76. With the use of a filler material of the type and quantity described above and below (e.g. the relatively low thickness), the contouring benefit of the foam core can still be maintained to a favorable extent while the filler material also provides a degree of added breathability in the region with high comfort and favorable pressure level maintenance. This filler material is preferably a non-unitary, loose fill material contained within individual, sealing pockets. The preferred embodiment also features a non-planar (at least on one side) core body that allows for height variations in the overall pillow, while maintaining a relatively common outer pocket thickness.

A preferred embodiment of the invention preferably includes separate pockets for the core and filler material so as to provide for example, a first ticking layer, a filler material layer, and a second ticking or barrier layer relationship between the body contact surface and core surface on at least one side and preferably on both sides as illustrated. An external pillow case fabric covering is also preferably provided in use. Also, while a smooth, non-convoluted exposed core surface is shown in the preferred embodiment, the present invention also includes other embodiments (not shown) including convoluted surface cores from the standpoint of, for example, a patterned configuration (e.g. a smooth, wavy convoluted upper surface such as a valley/protrusion, checkerboard or egg-carton configuration) or more general convolution(s) such as forming an interior or edge valley or slot and/or a raised contour section for extension into a person's neck cavity, for example.

FIGS. 7–9 above show schematically the preferred pillow core outer surface outline for core 76. FIG. 9 provides a top plan view showing a preferred rounded corner rectangular configuration having elongated length L and width W. FIG. 9 further illustrates the preferred rounded corners C for core 76. FIG. 7 illustrates a side elevational view of core 7 showing its length L and maximum height H and the preferred generally ellipsoidal outline for each. FIGS. 7 and 8 illustrate the length and width of core 76 having a "stretched" ellipsoidal shape with an elongated intermediate region which shape is well suited as a comfortable core shape in the present invention. FIG. 8 shows the width-wise outline for core 76 of width W and height H, and the stretched ellipsoidal configuration, but to a lesser extent than the elongated sides shown in FIG. 7. FIGS. 7 and 8 illustrate curvature C1 for the long side and curvature C2 for the shorter width curvature of core 76 with each preferably falling from 10 to 50 degrees relative to the degree of curvature of the outer surface. The top surface and below surface width contour of the pillow preferably are equal in curvature as is preferably the top and bottom lengthwise curvature of the pillow. The above curvature range provides for the formation of both thin (e.g. 5.5 inch maximum core height) and thick (e.g. 6.5 inch maximum core height) pillows. A well suited sub-range for C1 is 10 to 50° with 18.5° being well suited for a thin pillow and 32° well suited for a thick pillow. A range of 15 to 60° is well suited for C2 with its value preferably being within 15° of C1 (e.g. 42° for C2 in a thick pillow and 24° for a thin pillow).

In a preferred embodiment, which is well suited for use with pocket filler features of the present invention (and is generally a universal adult size) and well suited for standard pillow case insertion without great difficulty, L=23.0 inches; W=16.0 inches and H=5.5 inches. A ±2 to ±7 inch deviation for L, a ±2 to ±5 inch deviation relative to W, and a ±1.25 inch deviation for H represent preferred size deviations for a typical adult pillow embodiment of the present invention. The cover's intermediate maximum pocket expansion is designed to closely conform to the core body received while still allowing for easy insertion and removal (e.g. a 0.5 to 2 inch clearance). A variety of consumer option sizes are also a feature of the present invention such as a 6 inch or "high loft" embodiment or a miniaturized (e.g. 10 inch wide travel version with equivalent ratio dimensioning) or an expansive length size of 30 inches are representative examples.

Figure 10:
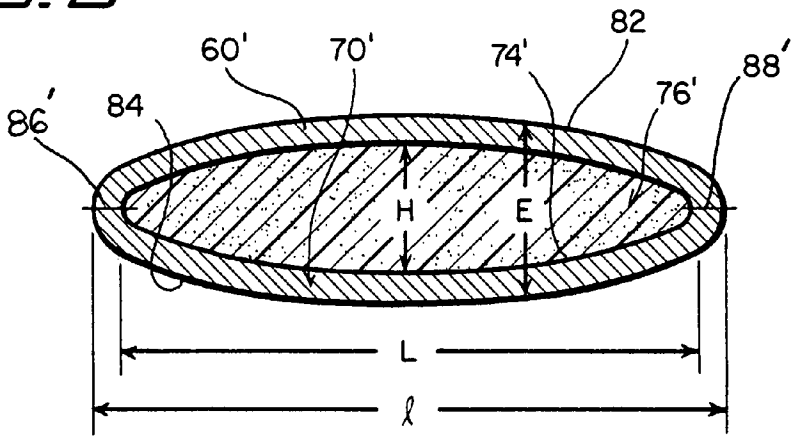
FIG. 10 shows a schematic view of a pillow of the present invention in side view with filler and outer covering.

FIG. 10 illustrates, schematically, the preferred filler/core interrelationship (e.g., well dispersed loose down or polyester staple fiberfill material within pockets used with a unitary foam core). Preferably the filler thickness (e.g. an average thickness with a common thickness throughout within the pockets representing a preferred embodiment, as the preferred filler material types like those described above typically avoid clumping and are generally evenly dispersed throughout the pocket) of 12 to 25% for one pocket relative to height H is preferred, with 12 to 20% and 16 to 20% representing suitable sub-ranges and a ratio of 1:5.5 being well suited for many uses of the present invention (i.e. a 1 inch pocket thickness to a 5.5 inches maximum core height).

As can be seen from the figures, the preferred embodiments feature filler pockets that are on average of the same height, and conform to the core surface like the domed core described above, except for perhaps some minor compression along the upper and lower pocket joining edges. This peripheral compression in thickness is minimized to some extent however, when utilizing the preferred intermediate panel arrangement of the present invention such as the gusseted intermediate panel described above. A generally common pocket thickness across the surface of the pillow is preferred for consistent comfort as the size and contour manipulation of an integrated core body provides greater consistency in the final product in use as a thinner layer of the non-integrated filler material has less chance to migrate and/or clump to deviate from the preferred manufactured contact characteristics. Although less preferred, variations on this feature are contemplated under the present invention such as relying on the pocket volume characteristics to define a non-planar pillow surface (e.g. a greater or "over-stuffing" of a pocket) to define a higher central area relative to, for example, a planar surface core). Alternatively, a contoured depression in the pillow case is filled with filler to form a thicker, non-integrated filler zone.

FIG. 10 also illustrates a continuous, encompassing layer which is an alternate embodiment of the above described embodiment featuring an intermediate gusset dividing zone. FIG. 10 schematically represents an outer cover 82 which is core encompassing such as in the above described embodiment with an interior barrier 84 and end (preferably added) separators 86' and 88', which together define a multi-pocket embodiment as above (e.g. pockets 60', 70', and 74'), and can be formed with a dividing peripheral flange insert relative to the upper and lower layers defining each pocket which includes, for example, but less preferably, flanges directly fixed to the core. Within the outer pockets 60' and 70' is provided a filler material such as that described above and within the interior zone is core 76' formed of material such as that described above. In an alternate embodiment, which is less preferred, particularly when using a visco-elastic core in view of its tackiness and from the standpoint of the potential for some preferred types of filler material to migrate or clump, the filler material is provided directly in contact with the core (i.e. without the inner pocket liner) but preferably with side and/or end separators secured to the core. Also, rather than direct top and bottom cover securement about their respective peripheries, an alternate embodiment of the invention features an intermediate side wall panel therebetween (vertically extending and planar rather than a more preferred gusset arrangement with or without access means). Under this latter embodiment, a pocketed arrangement like that described above is preferred, but the present invention also features a pocketless embodiment, preferably with the core extending into contact or close to contact (<⅛ to ¼ inch spacing) relative to the surrounding intermediate panel to form at least to some extent, a free migration blocking relationship therebetween. The above described filler thickness ranges are applicable for these alternate embodiments relative to FIG. 10 as well, and the invention includes the use of the same upper and lower thickness values as well as different upper and lower thickness values (e.g. the low end of the range of filler thickness and the upper end of the range to provide a degree of comfort choice options to the user). For the added sealing effect, however, the above described independent pocket configuration are preferred. FIG. 10 also illustrates pillow dimension references 1 and E.

Figure 11:
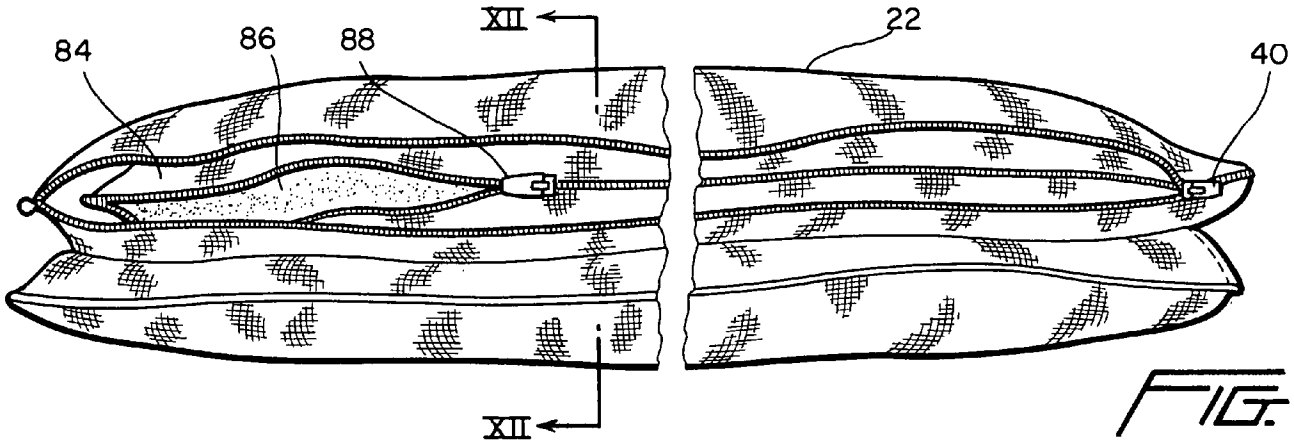
FIG. 11 shows an end elevational view of an alternate embodiment of the pillow of the present invention.
Figure 12:
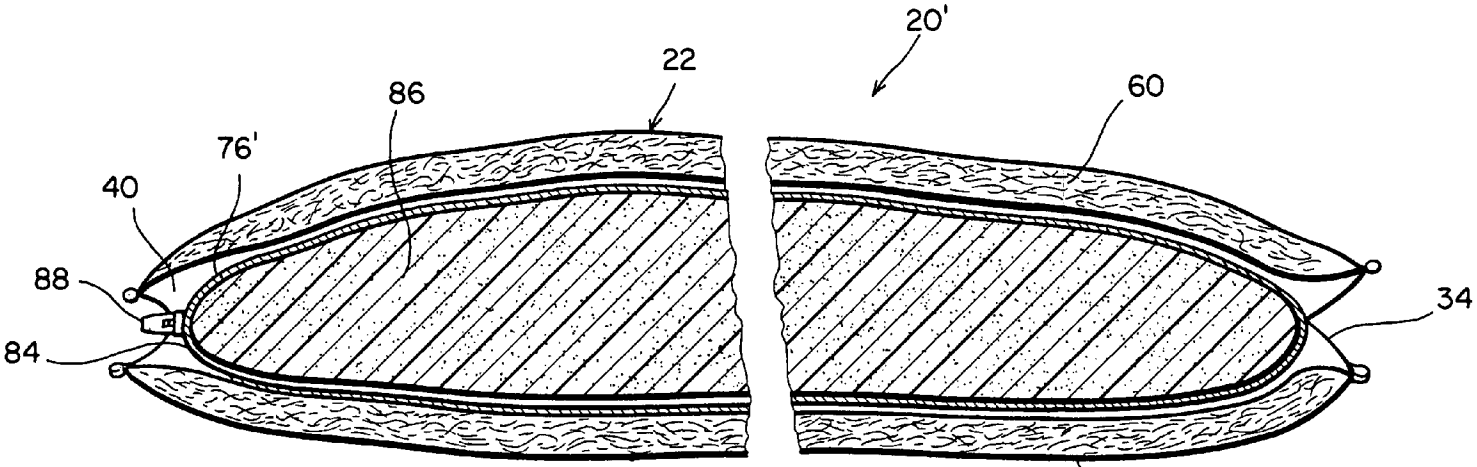
FIG. 12 shows a cross-sectional view taken along cross-section line XII—XII in FIG. 11.

FIGS. 11 and 12 illustrate an alternate pillow 20' embodiment of the present invention wherein a similar triple pocket ticking cover 22 as that described above for FIG. 1 is utilized having upper and lower pockets 60 and 70, intermediate core pocket 74 and intermediate gusset zone 34.

Core 76' is of a different construction than the above described core in having an inner core covering 84 which surrounds an interior core body 86 such as the above described visco-elastic high density polyurethane foam core. In a preferred embodiment, inner core covering 84 is a pocketless covering formed of a 75% cotton/25% polyester mix with a velour type texture, inner core covering (preferably the velour surface provided as the exterior cover surface). Inner core covering 84 preferably also has three non-openable side edges and a fourth side edge having access means such as zipper 88 (in similar fashion to the preferred pocketed covering 22 or running along an elongated side instead). The filler represented in FIG. 12 is a polyester fiber based filler having the above described characteristics.

FIGS. 11 and 12 are also illustrative of the refurbishing potential of the present invention relative to a pre-existing pillow. That is, the multi-pocket cover can be used to upgrade pre-existing, earlier purchased pillows. Also, although the pocketed pillow cover of the present invention can be used for direct contact with the user, a pillow case is preferably placed over the pocketed cover 22' (as is the case for the above described pillow embodiments) as protection from spoiling, for example. FIG. 11 further illustrates the preferred corresponding dual zipper end arrangement relative to the pocketed cover, with each zipper being shown partially opened exposing the interior core body with core covering received in the intermediate pocket of ticking cover 22.

While the above described disclosure is directed at preferred pillow embodiments of the present invention, various other pillows and non-pillow cushion and pad embodiments are also intended to be encompassed by the present invention as schematically illustrated in FIG. 13, for example. In FIG. 13, where is disclosed a core body or layer or planar pad 92 such as a solid body (e.g. foam body of polyurethane or foam core or a laminated or multi-section core arrangement with or without visco-elastic foam) on which is supported a filler material pocketed layer 94. Boundary layer 98 is preferably defined by an interior layer of material such as the interior layer of a pocket covering which is preferably sealed about its periphery with a means to access at one end or side to define pocketed layer 94. Pocketed layer 94 preferably has the filler material and thickness range values described above for the other embodiments such as a 1 to 2 inch thickness filler material layer of non-integrated filler material such as down of fiberfill preferably having similar thickness ratios as described above between the immediately supporting foam core and the filler material pocketed barrier. The pocketed layer is preferably designed to extend all the way around the supporting core body or layer 92. A second similar or different filler material layer 100 is shown in dashed lines in FIG. 13 to illustrate the option of providing a second filler material layer which, like the top, is preferably sealed in a second pocket with interior pocket layer 98'. With layer 100 present, it can be joined to the upper layer such as in the gusset arrangement described above to form an inner body pocket relative to body 92 or by direct pocket peripheral edge joining or by way of a non-gusseted intermediate independent peripheral panel. Thus, a planar pad 92, for example, is covered with upper and lower pocketed filler filled layers with connected/shared peripheral edging keeping the body 92 encompassed. This pad/cushion can be used in a variety of settings such as a mattress pad (e.g., a futon pad, pet bed or sofa bed or topper mattress pad). Core body 92 can be varied to best suit the intended usage, such as a minimized height for the core and/or pockets for use as a mattress pad (e.g., a core of 2 to 3 inches thickness) to supplement a preexisting mattress or is made of higher thickness values like those described above for use as, for example, a futon or sofa bed mattress. Thickness ranges for the core pad will depend on use, with 1 to 12 inches being illustrative of a representative range with 2 to 6 inches illustrative of a preferred sub-range, and with a 1 to 2 inch down or fiber based filler pocket thickness being preferred.

While the invention has been described in detail with reference to specific embodiments thereof, it will be apparent to one skilled in the art that various changes and modifications can be made, and equivalents employed, without departing from the scope of the appended claims.

What is claimed is:

1. A cushion apparatus, comprising:

a first flexible pocket defining a filler reception cavity;

first pocket filler material received within the reception cavity of said first flexible pocket, and said first pocket filler material being formed of a compilation of individual filler material components;

a second flexible pocket defining a second filler reception cavity;

second pocket filler material received within the reception cavity of said second flexible pocket; and a flexible foam core which is positioned between said first and second flexible pockets, and wherein said core has a maximum thickness which is greater than a thickness of said first flexible pocket with said first pocket filler material, and wherein said core has a peripheral configuration that is generally commensurate with a peripheral configuration of the cushion apparatus, and wherein said first pocket has a thickness of 12 to 25% relative to a maximum height of said core and wherein said first and second flexible pockets are loosely connected together via a non-taught intermediate panel section which is connected to a peripheral region of said first and second flexible pockets, so as to allow said first and second pockets to laterally adjust independently relative to each other despite a full expansion state in said core.

2. The cushion apparatus of claim 1 wherein said second pocket filler material is formed of a compilation of individual filler material components.

3. The cushion apparatus of claim 2 wherein the first and second pocket filler material includes a down material.

4. The cushion apparatus of claim 2 wherein the first and second pocket filler material includes a polyester fiberfill material.

5. The cushion apparatus of claim 2 wherein the first and second pocket filler material includes a fiber-ball material.

6. The cushion apparatus as recited in claim 1 wherein the first pocket filler material is a down material.

7. The cushion apparatus as recited in claim 6 wherein the down received in the reception cavity of said first flexible pocket is in an amount of 2 to 5 ozs.

8. The cushion apparatus as recited in claim 6 wherein the average thickness of said first pocket is 0.75 to 1.25 inches.

9. The cushion apparatus as recited in claim 1 wherein the first pocket filler material is a polyester fiberfill material.

10. The cushion apparatus as recited in claim 9 wherein the fiberfill received in said first reception cavity of said first flexible pocket is in an amount of 5 to 8 ozs.

11. The cushion apparatus as recited in claim 9 wherein the average thickness of said first pocket is 0.75 to 1.25 inches.

12. The cushion apparatus of claim 1 wherein the filler material received in the reception cavity of said first flexible pocket is of a quantity of 2 to 12 ozs. and forms an average thickness in the first pocket of 0.5 to 2 inches.

13. The cushion apparatus of claim 12 wherein the filler material received in the reception cavity of said first flexible pocket is of a quantity of 2 to 8 ozs. and forms an average first pocket to maximum core height thickness ratio of 12% to 20%.

14. The cushion apparatus of claim 1 wherein said core is formed of a polyurethane foam material.

15. The cushion apparatus of claim 1 wherein said compilation includes components which are independent from one another and free to move independently within said first pocket, and said foam core is a monolithic, visco elastic foam body.

16. The cushion apparatus of claim 1 wherein a half of a maximum core height is greater than the thickness of said first pocket.

17. The cushion apparatus of claim 16 wherein the half of the maximum core height is greater than or equal to a sum of thicknesses in said first and second pockets.

18. The cushion apparatus of claim 1 wherein the filler material for said first pocket is of a common type and amount as that of said second pocket.

19. The cushion apparatus of claim 1 wherein each of said pockets are individually sealed and said filler is comprised of grouped individual filler components received within said sealed cavities.

20. A cushion apparatus, comprising:

a first flexible pocket defining a filler reception cavity;

first pocket filler material received within the reception cavity of said first flexible pocket, and said first pocket filler material being formed of a compilation of individual filler material components;

a second flexible pocket defining a second filler reception cavity;

second pocket filler material received within the reception cavity of said second flexible pocket; and a flexible foam core which is positioned between said first and second flexible pockets, and wherein said core has a maximum thickness which is greater than a thickness of said first flexible pocket with said first pocket filler material, and wherein said core has a peripheral configuration that is generally commensurate with a peripheral configuration of the cushion apparatus, and wherein said core is a monolithic foam body having a convex central area surface supporting said first pocket.

21. The pillow cushion of claim 20 wherein said core is a monolithic foam body formed entirely of a visco-elastic material.

22. A cushion apparatus, comprising:

a first flexible pocket defining a filler reception cavity;

first pocket filler material received within the reception cavity of said first flexible pocket, and said first pocket filler material being formed of a compilation of individual filler material components;

a second flexible pocket defining a second filler reception cavity;

second pocket filler material received with the reception cavity of said second flexible pocket; and a flexible foam core which is positioned between said first and second flexible pockets, and wherein said core is formed of a visco-elastic foam material, and said foam core is dimensioned to extend out to be generally peripherally commensurate with a peripheral encompassing edge of said cushion apparatus.

23. The cushion apparatus of claim 22 wherein the filler material received in the reception cavity of said first flexible pocket is down.

24. The cushion apparatus of claim 23 wherein the filler material received in the reception cavity of said second flexible pocket is down.

25. The cushion apparatus of claim 22 wherein said core is a foam material having a density of 30 to 60 kg/m3 and a hardness range of 30N to 40N measured at 25% compression at 20 degrees Celsius, and wherein said first pocket has a thickness of 12 to 25% relative to a maximum height of said core.

26. A cushion apparatus, comprising:

a first flexible pocket defining a filler reception cavity;

first pocket filler material received within the reception cavity of said first flexible pocket, and said first pocket filler material being formed of a compilation of individual filler material components;

a second flexible pocket defining a second filler reception cavity;

second pocket filler material received within the reception cavity of said second flexible pocket; and a flexible foam core which is positioned between said first and second flexible pockets, and wherein said core has a maximum thickness which is greater than a thickness of said first flexible pocket with said first pocket filler material, and wherein said core has a peripheral configuration that is generally commensurate with a peripheral configuration of the cushion apparatus, and wherein said first and second flexible pockets are connected together with a v-shaped cross-sectioned panel.

27. A cushion apparatus, comprising:

a first flexible pocket defining a filler reception cavity;

first pocket filler material received within the reception cavity of said first flexible pocket, and said first pocket filler material being formed of a compilation of individual filler material components;

a second flexible pocket defining a second filler reception cavity;

second pocket filler material received within the reception cavity of said second flexible pocket; and a flexible core which is positioned between said first and second flexible pockets; and an intermediate panel section which extends about said core and is connected to said first and second pockets; and wherein said core is a monolithic, foam material core having a density of 30 to 60 kg/m$^3$ and a hardness range of 25N to 90N measured at 25% compression at 20 degrees Celsius, and said core having a peripheral configuration that is generally commensurate with a peripheral configuration of said intermediate panel section.

28. The cushion apparatus of claim 27 wherein the harness range is 30 to 40N, and wherein said first pocket has a thickness of 12 to 25% relative to a maximum height of said core.

29. A pillow cushion, comprising:

a covering having a first pocket with a reception cavity for receiving filler, a second pocket with a reception cavity for receiving filler, and an intermediate pocket; and a core received in said intermediate pocket wherein said core comprises a foam body having a convex surface in contact with said first pocket, and which core fully extends between front and rear peripheral edging of said pillow cushion, with the front and rear peripheral edging being longer in length than left and right side peripheral edging of said pillow cushion, and wherein said core is a monolithic foam body formed entirely of a visco-elastic material.

30. The pillow cushion of claim 29 wherein said pillow cushion comprises filler received in said first and second pockets which filler is comprised of grouped individual filler components, and wherein said first flexible pocket with first pocket filler material has a generally common pocket thickness over its entire area.

31. The pillow cushion of claim 30 wherein said filler includes down.

32. The pillow cushion of claim 31 wherein said filler material is of a quantity of 3 to 8 ozs. in each pocket.

33. The pillow cushion of claim 29 wherein said first and second pockets are connected along exterior regions of said first and second pockets.

34. The pillow cushion of claim 33 wherein said first and second pockets are connected by a cover panel extending peripherally about said core.

35. The pillow cushion of claim 34 wherein said cover panel is a gusseted cover panel having upper and lower gusset panel sections.

36. The pillow cushion of claim 35 wherein said gusseted cover panel includes a bead extending about one of said upper and lower gusset panel sections.

37. The pillow cushion of claim 29 wherein said core is a foam material having a density of 30 to 60 kg/m3 and a hardness range of 30N to 40N measured at 25% compression at 20 degrees Celsius.

38. A pillow cushion, comprising:

a covering having a first pocket with a reception cavity for receiving filler, a second pocket with a reception cavity for receiving filler, and an intermediate pocket; and a core received in said intermediate pocket wherein said core comprises a monolithic foam body having a convex surface in contact with said first pocket, wherein said core comprises a foam body having an upper convex surface and a bottom convex surface with each convex surface sloping relative to both a length and a width of the pillow cushion, and wherein said core is configured to provide direct underlying cushion support relative to essentially an entire exposed surface of said first pocket.

39. The pillow cushion of claim 38 wherein said first and second pockets with received filler material have an average thickness range of 0.75 to 1.5 inches.

40. The cushion apparatus of claim 38 wherein said first pocket has a thickness of 12 to 25% relative to a maximum height of said core.

41. A method of forming a pillow, comprising:

providing a cover having a first pocket, a second pocket, and an intermediate pocket;

inserting filler material in said first and second pockets, with said filler material being formed of a compilation of individual filler material components; and inserting a core filler in said intermediate pocket, with said core filler being inserted is a foam insert having a greater maximum thickness than that of said first pocket and said core filler having a peripheral configuration that is essentially commensurate with a peripheral configuration of said pillow, wherein inserting the core filler includes inserting a visco-elastic foam body.

42. The method of claim 41 wherein inserting filler material includes inserting down filler material in each of said pockets.

43. The method of claim 41 wherein inserting filler material includes inserting fiberfill filler material in each of said pockets.

44. The method of claim 41 wherein the core filler being inserted has a maximum thickness greater than that of said second pocket, and said core filler is a monolithic, visco elastic molded foam body.

45. The method of claim 44 wherein the maximum thickness of said core filler is greater than that of a sum of thicknesses of said first and second pockets.

46. A head pillow cushion, comprising:

a first filler reception cavity;

first reception cavity filler material received within said first filler reception cavity, and said first reception cavity filler material being formed of a compilation of individual filler material components;

a second filler reception cavity;

second reception cavity filler material received with the second filler reception cavity; and a flexible, visco-elastic foam core which is positioned between said first and second reception cavities, said core having a maximum height thickness which is greater than a height thickness of said first reception cavity filler material in said first reception cavity; and wherein said core comprises a foam body having a convex surface which includes a cross-sectional convex curvature extending from a central region of the pillow cushion out to opposite front and rear edge regions of the pillow cushion, with the front edge region of the pillow cushion being positioned for neck support of a user of the pillow cushion, and wherein said core is a foam material having a density of 30 to 60 kg/m$^3$ and a hardness range of 25N to 90N measured at 25% compression at 20 degrees Celsius and wherein said core comprises a monolithic foam body.

47. The pillow cushion of claim 46 wherein said first pocket has a thickness of 12 to 25% relative to a maximum height of said core.

48. The pillow cushion of claim 46 wherein the filler material received in the reception cavity of said first flexible pocket is of a quantity of 2 to 12 ozs. and forms an average thickness in the first pocket of 0.5 to 2 inches.

49. The pillow cushion of claim 46 wherein each of said reception cavities are individually sealed and said filler is comprised of grouped individual filler components received within said sealed cavities.

50. The pillow cushion of claim 46 wherein said core has a maximum central thickness and the maximum central thickness is greater than a corresponding central region of the first reception cavity filler material, and said core is a molded visco elastic foam body.

* * * * *